US007032908B2

(12) United States Patent
Melvin

(10) Patent No.: US 7,032,908 B2
(45) Date of Patent: Apr. 25, 2006

(54) MECHANIC'S CREEPER

(76) Inventor: Darrell E. Melvin, 17015 Sandhill Rd., Georgetown, DE (US) 19947

( * ) Notice: Subject to any disclaimer, the term of this patent is extended or adjusted under 35 U.S.C. 154(b) by 194 days.

(21) Appl. No.: 10/655,203

(22) Filed: Sep. 5, 2003

(65) Prior Publication Data

US 2005/0051980 A1 Mar. 10, 2005

(51) Int. Cl.
*B25H 5/00* (2006.01)

(52) U.S. Cl. ..... 280/32.6; 280/79.11

(58) Field of Classification Search ..... 280/32.5, 280/32.6, 638, 35, 79.11; 5/625–627, 112, 5/114; D34/23
See application file for complete search history.

(56) References Cited

U.S. PATENT DOCUMENTS

| | | | | |
|---|---|---|---|---|
| 1,104,398 | A * | 7/1914 | Zimmerman | 280/32.6 |
| 2,487,706 | A * | 11/1949 | Happ | 280/32.6 |
| 2,636,705 | A * | 4/1953 | Stanton | 248/129 |
| D270,962 | S * | 10/1983 | Martell | 280/32.6 |
| 4,698,731 | A | 10/1987 | Johns, Sr. | |
| 4,889,352 | A * | 12/1989 | Chamberlin et al. | 280/32.6 |
| 4,986,558 | A | 1/1991 | Morris | |
| 5,195,763 | A * | 3/1993 | Scott et al. | 280/32.6 |
| 5,299,826 | A | 4/1994 | Flowers | |
| 5,330,211 | A | 7/1994 | Nicholson | |
| 5,460,392 | A | 10/1995 | Hansen | |
| 5,494,305 | A * | 2/1996 | Chen | 280/32.6 |
| 5,624,126 | A | 4/1997 | Vosbikian et al. | |
| RE35,732 | E | 2/1998 | Shockley | |
| 5,863,053 | A * | 1/1999 | Berry | 280/32.6 |
| D406,683 | S | 3/1999 | Taylor et al. | |
| 5,895,062 | A | 4/1999 | Miles et al. | |
| 6,059,298 | A * | 5/2000 | Tucker | 280/32.6 |
| 6,238,069 | B1 | 5/2001 | Miles | |
| 6,705,622 | B1 * | 3/2004 | Whiteside | 280/32.6 |
| 2002/0109991 | A1 | 8/2002 | Alsup | |

FOREIGN PATENT DOCUMENTS

| | | |
|---|---|---|
| GB | 2178702 | 2/1987 |
| GB | 2198994 | 6/1988 |
| GB | 2251828 | 7/1992 |
| WO | 88/09709 | 12/1988 |

OTHER PUBLICATIONS

McMaster-Carr Supply Company Catalog No. 106 (Date Unknown), p. 1359, Series of Creeper Models A Through H.

* cited by examiner

*Primary Examiner*—Chris Ellis
*Assistant Examiner*—Brian Swenson
(74) *Attorney, Agent, or Firm*—Richard C. Litman

(57) ABSTRACT

The present mechanic's creeper is particularly well suited for use by professional drivers and others who have need to perform occasional maintenance and other work beneath a vehicle while on the road. The present creeper includes a retractable extension, which enables the device to be collapsed from its fully extended working configuration to a more compact size for storage within a storage case for carriage within a small storage area in a truck or other motor vehicle. The configuration of the retractable extension still provides an enclosed storage area for tools and equipment between the frame rails of the creeper, even when the extension is retracted. The device also includes removable arm rests with tool pouches for convenience while working, as well as articulated work lights which may be aimed to suit the user and a warning light which may be attached to the device.

18 Claims, 4 Drawing Sheets

MECHANIC'S CREEPER

BACKGROUND OF THE INVENTION

1. Field of the Invention

The present invention relates generally to equipment and tools for use by mechanics and others in the maintenance of motor vehicles and other devices having little ground clearance, and more particularly to a low, wheeled creeper to facilitate access beneath a motor vehicle. The present creeper is collapsible for compact storage, yet includes a number of convenient features such as tool storage, work lights, etc. for greater versatility.

2. Description of the Related Art

The mechanic's creeper in its basic form, has been known for decades. These devices greatly facilitate access beneath a motor vehicle or other low-slung mechanical device, for work beneath the machine. Creepers are conventionally constructed as relatively small, thin, generally rectangular platforms having sufficient size to support the back, hips, and head of a supine person lying thereon, with a small roller, caster, or wheel at each corner to minimize ground clearance. While virtually every mechanic owns at least one such device, they are impractical for use by professional drivers and others who may have need to perform maintenance beneath a vehicle while away from their home base or a maintenance facility.

The reason conventional creepers are impractical for such on-the-road use is that they are generally constructed of a single, rigid sheet of material, usually a relatively thin plywood. No provision is made for folding such creepers for more compact storage. While such creepers are relatively thin, they still require a few linear feet of storage space to accommodate their unbroken lengths. As a result, a very few folding creepers have been developed. However, the few folding creepers known to the present inventor, are all relatively bulky in thickness when folded. This obviates much of the advantage of their reduced length when folded. Moreover, the folded configuration of such creepers does not allow any room for storage of tools or equipment, accessories such as armrest pads, or supplemental work lighting, all of which are desirable features in such devices.

The present invention responds to this need by providing a mechanic's creeper with a telescoping extendible frame, upon which a supplemental lower back or hip rest cushion may be installed to expand the present creeper to the equivalent of a full length conventional creeper. The use of a telescoping frame to adjust the length of the present creeper, provides sufficient room in the remainder of the frame for the storage of tools, parts, and equipment, as well as the hip rest cushion for the frame extension. The present creeper may be provided with adjustably positionable supplemental lighting and removable arm rests with tool pouches, with a specially configured container being provided for storage of the components.

A discussion of the related art of which the present inventor is aware, and its differences and distinctions from the present invention, is provided below.

U.S. Pat. No. 4,698,731 issued on Oct. 6, 1987 to Frederick W. Johns, Sr., titled "Mechanic's Creeper," describes a generally conventional creeper having an extension attached to the head end thereof, with a light installed on the extension. The extension is connected to the head of the creeper by a butt joint, with a metal plate securing the two components together; no folding or collapsible structure is provided for the extension. As the main problem of a conventional creeper for use in the intended operating environment of the present invention is its length, the addition of a permanently installed extension on the Johns, Sr. creeper teaches away from the present invention. Moreover, Johns, Sr. does not provide any means for tool or parts storage, arm rests, or other features provided in the present creeper.

U.S. Pat. No. 4,986,558 issued on Jan. 22, 1991 to Philip W. Morris, titled "Attachment For Mechanic's Creeper," describes a conventional creeper formed of a single, unitary sheet of material and having an extension permanently attached thereto. The extension includes lighting along the sides and head end thereof, as well as a tool storage tray disposed at the head end of the creeper. The same drawbacks as noted in the discussion of the creeper of the '731 U.S. Patent to Johns, Sr. immediately above, i.e. the lack of any means for collapsing or folding the device for compact storage, are noted here as well.

U.S. Pat. No. 5,299,826 issued on Apr. 5, 1994 to Henry C. Flowers, titled "Multi-Function Cart," describes a utility cart having an adjustable width, but no adjustment for the length is provided. The Flowers cart includes numerous accessories and components in order to provide an extremely versatile device. One of the components which may be added to the Flowers cart is a relatively thin and flat, padded sheet of material which permits the cart to be used as a creeper. However, the thickness of the undertray of the device with the creeper portion installed thereon, results in a relatively thick assembly which is not desirable when working in the limited clearance beneath a vehicle. Flowers does not disclose any provision for lighting, arm rests, or lateral storage for tools and parts in his cart, which features are all a part of the present creeper invention.

U.S. Pat. No. 5,330,211 issued on Jul. 19, 1994 to Michael A. Nicholson, titled "Mechanic's Creeper," describes a creeper having a slide-out extension for supporting the buttocks or hips of a person reclining thereon. The headrest also pivotally folds on the Nicholson creeper, for further reduction of length for storage. However, the extension comprises a nearly full width panel having considerable length, thereby taking up much of the space between the frame members when the extension is retracted into its storage position. The extension of the present creeper comprises a tubular frame which telescopes into the peripheral tubular frame of the primary structure, with a relatively small hip support pad or cushion removably installable on the deployed extension. The result is considerably more storage room between the frame members of the present creeper, than provided in the Nicholson creeper. Moreover, it is noted that the extension of the Nicholson creeper does not have any support wheels or casters, but is cantilevered from the primary frame structure with its wheels or casters. It would appear that this would overbalance the Nicholson creeper when most of the weight of an occupant is resting toward or upon the deployed extension, as occurs from time to time during use and particularly when initially lying down upon or rising from the creeper. The tool storage area of the Nicholson creeper is necessarily limited by the room required for storage of the extension, as noted further above. The Nicholson storage drawers are accordingly relatively narrow and shallow, and do not provide sufficient room for many tools. In contrast, the storage area of the present creeper extends for substantially the entire width and length of the area defined by the frame of the device, with considerably less than half the storage space being taken up by the extension cushion. Moreover, Nicholson fails to provide any form of storage case or container for his assembly, whereas the present creeper is configured for storage in, and includes, a relatively compact storage container.

U.S. Pat. No. 5,460,392 issued on Oct. 24, 1995 to Michael R. Hansen, titled "Height Adjustable Universal Creeper Apparatus," describes a device having an open frame with a single vertical arm extending upwardly from the frame crossmember. A platform is attached to the upper end of the arm, and is telescopically adjustable in height. An extension tray is provided for holding tools and the like, but the tray is much too light to support a person working atop the creeper and any substantial weight placed on the extension tray would overbalance the assembly due to the lack of support beneath the extension. The Hansen creeper cannot be lowered for working beneath a vehicle or structure having relatively little ground clearance, as can the present creeper, but is adapted more for extending over otherwise difficult to reach structures.

U.S. Pat. No. 5,624,126 issued on Apr. 29, 1997 to Jack Vosbikian et al., titled "Mechanic's Creeper With Detachable Toolbox," describes a creeper having a recessed shoulder area in the platform, with the platform being supported by six wheels or casters. A removable tool tray may be attached to each side of the platform, if so desired. The Vosbikian et al. creeper appears to be of conventional length, and no folding or collapsing means is provided to reduce the size of the device for storage, unlike the present creeper with its telescoping extension. Moreover, no lighting or supplemental tool storage area beneath the platform are provided by Vosbikian et al., whereas the present mechanic's creeper invention includes such supplemental lighting and under platform tool storage.

U.S. Patent No. RE 35,372 reissued on Feb. 17, 1998 to Troy Shockley, titled "Transformable Mechanic's Creeper," describes a creeper having a folding center section comprising a pair of arms connecting the two end sections. One end may be positioned over the other to form a raised seating surface, if so desired. When the Shockley device is used as a creeper, an additional pad is placed in a tray at the end opposite the seating section end, to extend across the otherwise open center section. The removable pad nests within the peripheral frame members, thereby precluding any provision for tool or other storage therein. Moreover, Shockley does not provide any lighting means with his device.

U.S. Pat. No. 5,895,062 issued on Apr. 20, 1999 to Joseph J. Miles et al., titled "Foldable Creeper," describes a creeper having two sections joined at a central hinge or pivot at each frame side rail. Each section is supported by a series of four casters; the flexibility of the hinges in at least some configurations, requires centrally disposed wheels or casters to support the non-rigid frame. The cushions or pads of the Miles et al. creeper are nested between the frame rails, thereby precluding any space for tool storage. No supplemental lighting is disclosed for the Miles et al. creeper.

U.S. Pat. No. 6,238,069 issued on May 29, 2001 to Joseph J. Miles, titled "Light Bracket Assembly For Mechanics Creepers," describes an add-on device for a conventional creeper having a dropped transverse head member for the frame. The add-on bracket attaches to the open ends of the longitudinal frame members, beyond the head member of the frame and head support pad of the creeper. The Miles bracket is configured to hold a conventional mechanic's trouble light therein. The creeper is otherwise conventional, with no retractable extension for compact storage, tool storage means, or other features of the present creeper invention.

U.S. Patent Publication No. 2002/109,991 published on Aug. 15, 2002 to Andrew J. Alsup, titled "Mechanic's Creeper With Work Lighting," describes a creeper having a series of elongate lighting elements (fluorescent, etc.) disposed along the edges of the device. No folding or retractable elements, tool storage, arm rests, or articulated, adjustably positionable lighting is disclosed by Alsup in his creeper, which features are all parts of the present invention.

U.S. Pat. No. D-406,683 issued on Mar. 9, 1999 to Ken Taylor et al., titled "Oversized Drop Shoulder Creeper With T-Bar Support," illustrates designs for two embodiments of a creeper having a head and shoulder rest portion which may be raised or sloped upwardly as desired. No folding or retractable components in the frame, tool storage compartment(s), or lighting means are apparent in the Taylor et al. design.

British Patent Publication No. 2,178,702 published on Feb. 18, 1987 to Delmos Limited, titled "Crawler," describes a creeper having a primary structure molded from plastic or composite material. Lights are provided in recesses to each side of the headrest portion of the device, but these lights cannot be adjusted or aimed for maximum effectiveness. No closed tool storage or retractable/extendible portions of the device are provided in the Delmos Limited creeper.

British Patent Publication No. 2,198,994 published on Jun. 29, 1988 to Colin A. Pugh, titled "Crawler Board," describes a creeper having an angularly adjustable head and shoulder rest, but lacking tool storage, lighting, and other features provided by the present mechanic's creeper invention. As such, the creeper of the Pugh '994 British Patent Publication appears to more closely resemble the creeper of the '683 U.S. Design Patent to Taylor et al., described further above, than it does the present creeper invention.

PCT Patent Publication No. 88/09,709 published on Dec. 15, 1988 to Ingemar Friare, titled "A Fitter's Trolley," describes a creeper having an angularly adjustable back and headrest portion, with no lighting, tool storage, or retractable portions being disclosed. The creeper of the Friare '709 PCT Patent Publication thus resembles the creepers of the '683 U.S. Design Patent to Taylor et al. and the '994 British Patent Publication to Pugh, than it does the present creeper invention.

British Patent Publication No. 2,251,828 published on Jul. 22, 1992 to Mohammed A. Moghal, titled "Tool Trolley And Combined Seat," describes a roll around folding seat with folding lateral tool carrying extensions. The device is not truly a creeper, in that a person cannot lie down on the device in a supine position due to the seat structure and the relatively short length of the device. No means for extending the length of the device is disclosed for the Moghal tool trolley, nor is any lighting disclosed.

Finally, Catalog No. 106 from the McMaster-Carr Supply Company of Cleveland, Ohio (no date given, but believed to have been published in about 1996) discloses a series of eight different mechanic's creepers on page 1359, designated by the letters A through H. Creeper A appears to closely resemble the creeper of the Taylor et al. '683 U.S. Design Patent, discussed further above. Creeper B appears to closely resemble the creeper of the Miles et al. '062 U.S. Utility Patent, discussed further above. Creeper H appears to closely resemble the creeper of the Vosbikian et al. '126 U.S. Utility Patent, discussed further above, and includes a single light at the head end thereof. With the exception of the light shown on the creeper H, the discussions provided further above for the creepers similar to the creeper models A, B, and H of the McMaster-Carr Catalog are seen to apply here as well. None of the other creeper models illustrated in the McMaster-Carr Catalog appear to provide any retraction means, closed tool storage, or lighting means, which features are a part of the present mechanic's creeper invention.

None of the above inventions and patents, taken either singly or in combination, is seen to describe the instant invention as claimed. Thus a mechanic's creeper solving the aforementioned problems is desired.

SUMMARY OF THE INVENTION

The mechanic's creeper of the present invention is particularly well suited for carriage and use as a portable unit for professional drivers and others on the road who have need to perform maintenance, inspections, or other work beneath their vehicle while traveling. The present creeper retracts to a compact size for storage when not in use, and includes a telescoping extension for support of the hips or buttocks of the user when the extension is fully extended. A removable hip or buttock support pad or cushion is stored within the device until needed. The configuration of the present creeper also provides room for an enclosed tool or equipment storage compartment between the lateral frame rails of the device. A pair of removable armrests is also provided, with each rest including a tool pouch extending therefrom. One or more work lights are provided at the head end of the device, with the lights being articulated to allow a user of the present creeper to adjust or aim the lighting as desired. A warning light or reflector may also be provided at one or more points about the frame of the device, as desired. A storage and/or carrying case for the creeper and its accessories may also be provided.

Accordingly, it is a principal object of the invention to provide a mechanic's creeper including a retractable extension, providing for compact storage when not in use.

It is another object of the invention to provide such a creeper including an enclosed tool and supply storage compartment between the frame rails thereof.

It is a further object of the invention to provide such a creeper including removable arm rests, with each of the armrests including a tool storage pouch extending therefrom.

Still another object of the invention is to provide such a creeper including at least one articulated work light and at least one warning light.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
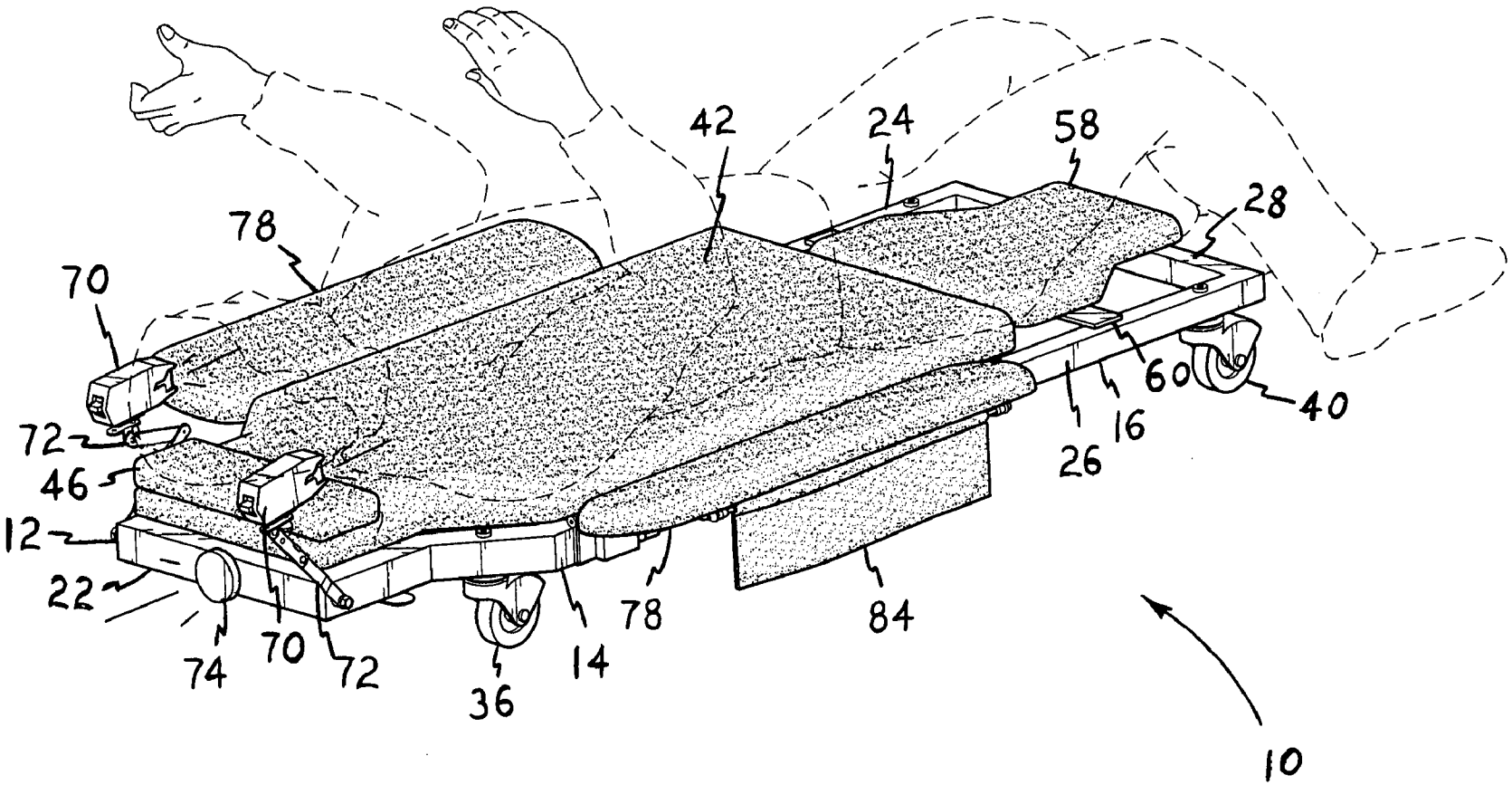
FIG. 1 is an environmental, perspective view of a mechanic's creeper according to the present invention, showing the device and many of its features in use.

The present invention comprises a mechanic's creeper having a number of features facilitating its use and providing for compact storage thereof when not in use. FIG. 1 of the drawings provides an illustration of the present creeper 10 in use, with the retractable frame extension shown in its extended position. The creeper 10 includes a hollow tubular frame assembly 12 comprising a main frame 14 to which most of the components are attached, and a frame extension 16 which telescopes into and out from the main frame 14. The frame assembly 12 may be constructed of any practicable material, but is preferably formed of square or rectangular cross section steel tube having reasonably thick walls, in order to provide the desired rugged construction and durability for the creeper 10. Alternative materials, e.g. round or square section aluminum tube, etc., may be substituted for the preferred steel material, if so desired, with consideration being made for appropriate wall thickness of the material in order to provide the required strength and durability.

The main frame portion 14 is formed of left and right side members, respectively 18 and 20, joined at their head ends by a head crossmember 22. The frame extension portion 16 is formed of left and right side extension members, respectively 24 and 26, joined at their foot or distal ends by a foot crossmember 28. (It should be noted that the term "foot" used herein to describe components of the present creeper 10, is not meant to indicate that these components are positioned near the feet of a person reclining on the creeper 10 when it is being used. The "foot" end of the creeper 10 in its extended position is generally positioned below the thighs of a person reclining on the creeper 10 when in use. The term "foot" when used to describe components of the present creeper 10, indicates those components opposite the head crossmember end 22 of the creeper 10.) These frame components 18 through 28 are more clearly shown in FIG. 3 of the drawings. The left and right side extension members 24 and 26 are formed of material having external dimensions configured to fit within the internal dimensions of the hollow main frame side members 18 and 20. Thus, the frame extension 16 may telescope into and out from the main frame 14 by means of the extension side members 24 and 26 sliding within the main frame side members 18 and 20, to extend and retract the overall length of the frame assembly 12 as desired.

Figure 2:
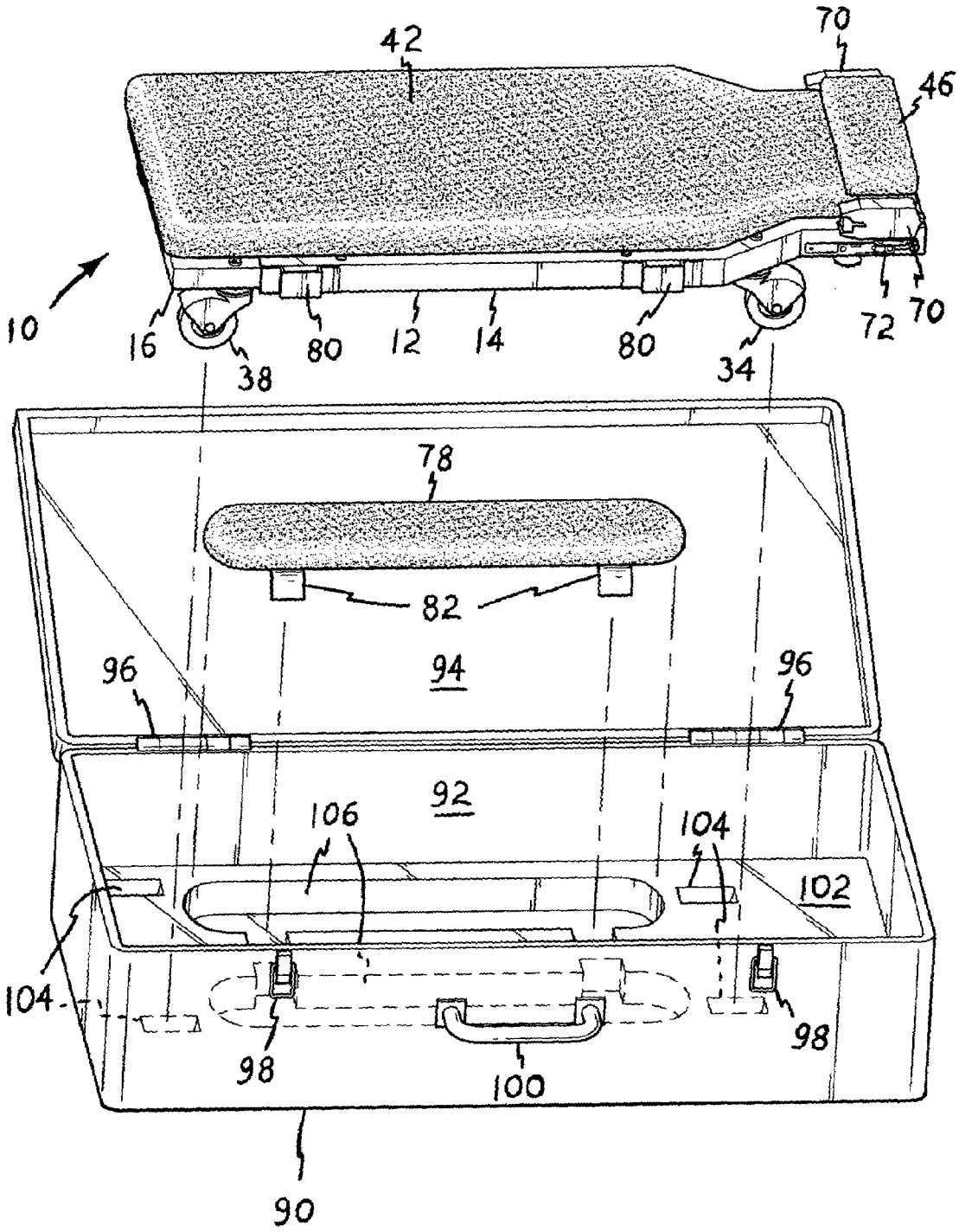
FIG. 2 is an exploded perspective view of the present mechanic's creeper with extension and lighting retracted and arm rests removed, for placement within its storage case.
Figure 3:
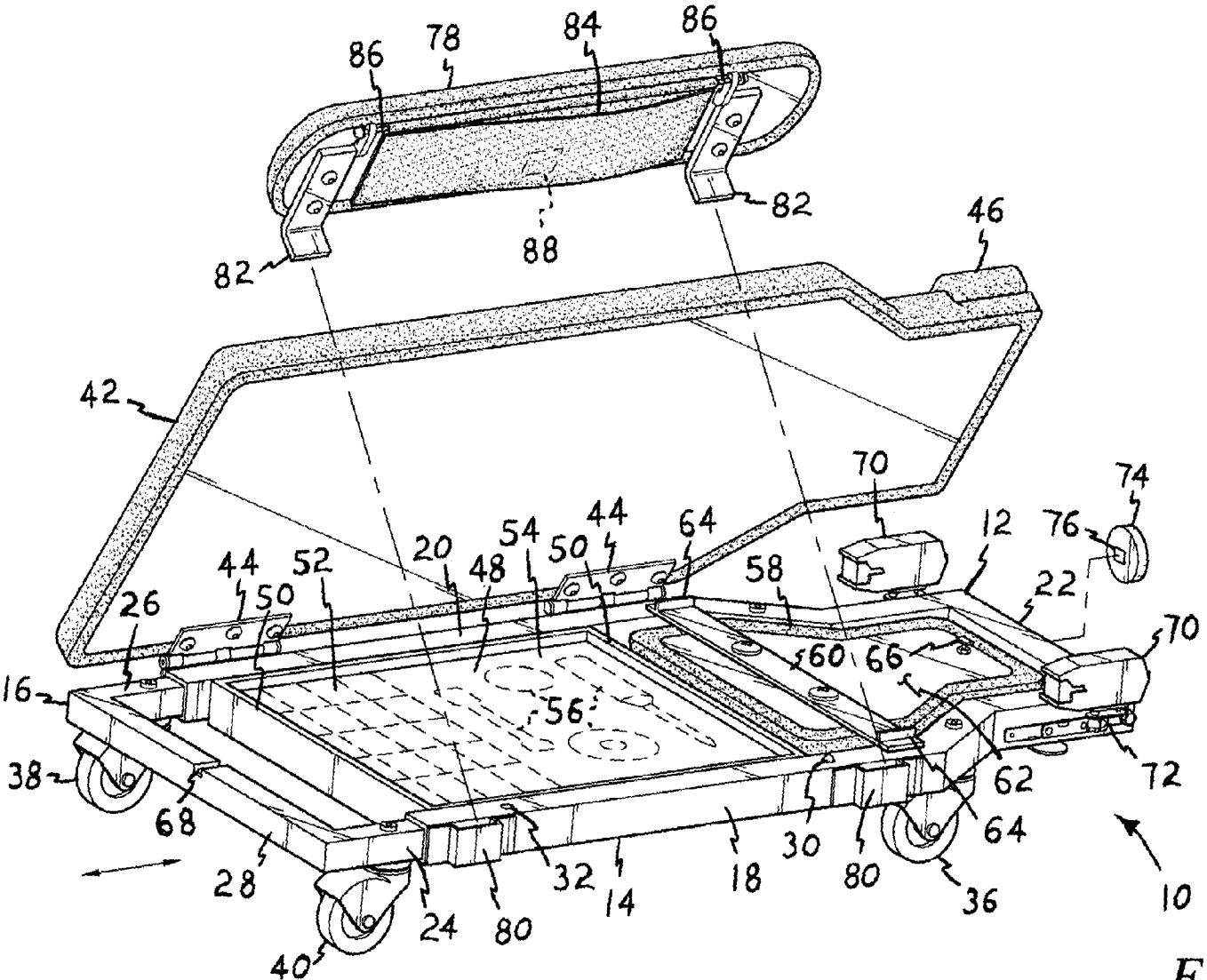
FIG. 3 is an exploded perspective view of the present mechanic's creeper with the back rest portion raised to access the tool storage compartment, and showing one of the arm rests and warning light removed.
Figure 4:
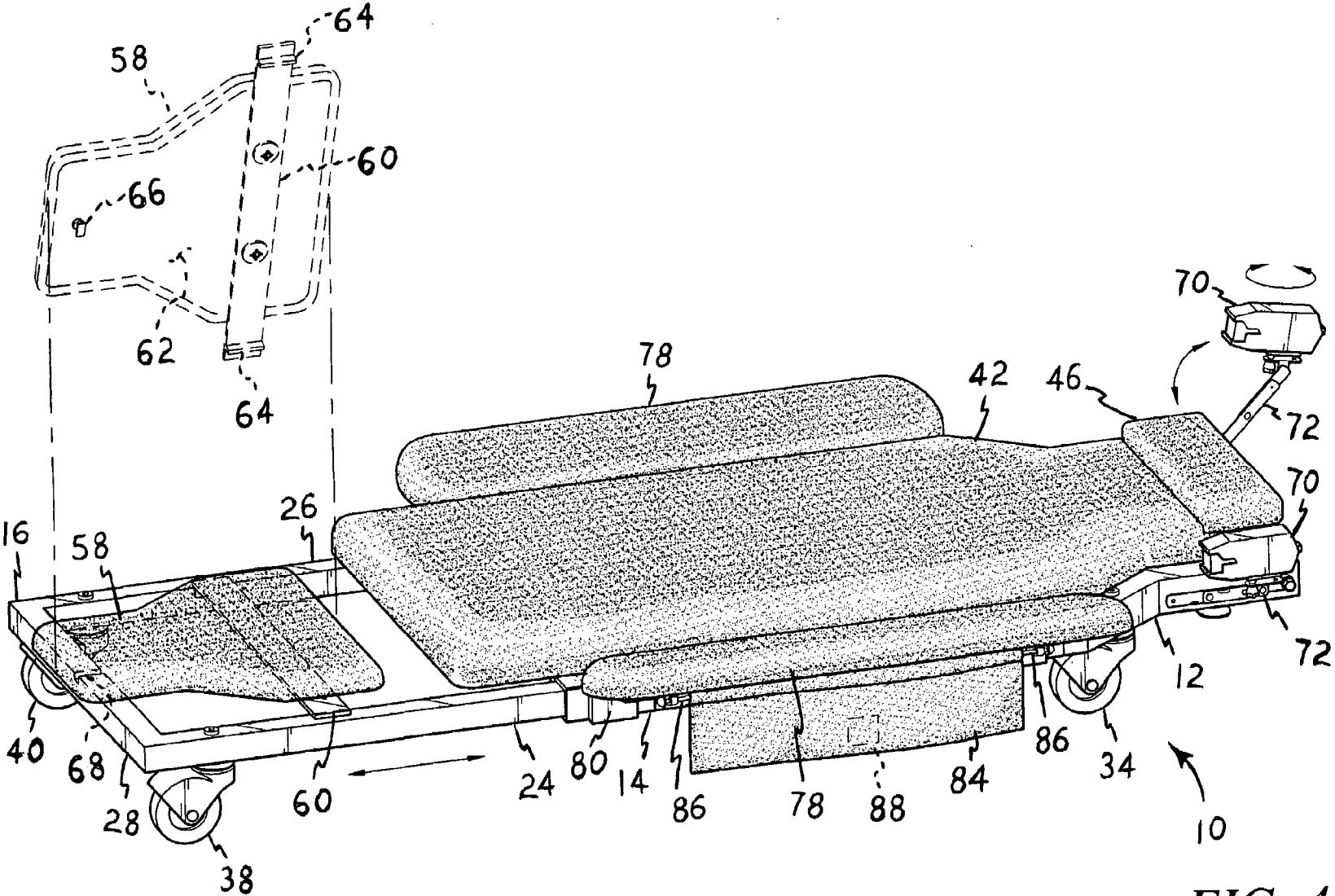
FIG. 4 is a perspective view of the present creeper, showing the creeper with the extension in its extended position and with other accessories installed and deployed for work.

A spring loaded button 30 projects laterally from one of the extension side members, e.g. left side extension member 24, and engages either a retraction lock hole or an extension lock hole 32 formed through the wall of the corresponding main frame side member, e.g. left side member 18, to lock the frame extension 16 in either its retracted position (as shown in FIGS. 2 and 3) or its extended position (as shown in FIGS. 1 and 4), as desired. Repositioning the extension 16 is accomplished by pressing the button 30 inwardly to disengage it from the hole 32, and sliding the extension 16 inwardly or outwardly as desired to its new position until the button 30 engages the appropriate hole 32.

Although the creeper 10 has an adjustable frame assembly 12, only four wheels or casters are required to support the creeper 10 due to the telescoping frame extension 16 being movable relative to the main frame portion 14 only along the longitudinal axis, and being immovably fixed laterally and vertically. Accordingly, swiveling left and right head end wheels or casters, respectively 34 and 36, extend below the main frame structure 14 near the head end and its crossmember 22, with swiveling left and right foot end casters or wheels, respectively 38 and 40, extending below the frame extension 16 adjacent the foot end crossmember 28 thereof.

The creeper 10 includes a back rest pad 42 which is hingedly attached to the main frame 14, e.g. to the right side member 20 thereof, by hinges 44, shown with the back rest pad 42 raised in FIG. 3. The back rest pad 42 may be secured to either side member 18 or 20 of the main frame portion 14, but is preferably attached to the side opposite the frame extension lock button 30, in order to facilitate access to the button 30. The back rest pad 42 has a narrower head end which is generally congruent with the narrower portion of the main frame 14 at the head end of the creeper 10, with a headrest 46 installed at the head end of the back rest pad 42.

Lifting the back rest pad 42 provides access to the space or area between the side rails or frame members 18 and 20 of the main frame portion 14. This otherwise empty area may be used for placement of a tool and equipment storage container 48 therein, as shown in FIG. 3. The tool and equipment container 48 may comprise a separate box or other structure which is placed between the two side frame members 18 and 20, or may be formed as an integral part of the structure of the main frame 14, by welding or otherwise securing a pair of opposed walls 50 across the frame 14, with a conventional floor panel (not shown) installed at the bottom of the container 48 area. The container 48 may include a parts storage area 52, and/or a tool tray area 54 having receptacles 56 (shown in broken lines) formed therein for holding one or more specifically configured tools (e.g. screwdriver and bits, wire stripping and cutting pliers, a combination wrench, etc.) therein.

Preferably, the main frame portion 14 and its overlying back rest pad 42 are relatively short, and extend only from the head to the approximate waist level of an average person using the creeper 10. This compact configuration provides for ease of storage of the device when it is not in use. However, this clearly leaves unsupported the hips and buttocks of a person using the creeper 10. While the extended frame extension 16 provides a supporting frame for the hips and buttocks of a person using the creeper 10, some form of planar support must be provided across the frame extension 16 when it is extended. Accordingly, a buttocks and hip support pad or cushion 58 may be removably attached to the frame extension 16, specifically to the foot crossmember 28 thereof. The buttocks support cushion 58 is tapered toward the foot end of the creeper when the cushion 58 is installed thereon, with this taper providing a precise fit for the cushion 58 beneath the narrower head end of the back rest pad 42 when the cushion 58 is not in use, as shown in FIG. 3.

The buttocks support cushion 58 includes a lateral support bar 60 extending across the bottom surface 62 thereof, with the bar 60 including opposed keeper tabs 64 extending therefrom which serve to preclude lateral movement of the cushion 58 when it is placed across the extended frame extension 16 for use. A locking tab 66 also extends from the bottom surface 62 of the buttocks cushion 58, and engages a mating slot 68 formed in the foot crossmember 28 of the frame extension 16. The locking tab 66 is aligned laterally relative to the installed orientation of the cushion 58, while the foot crossmember slot 68 is aligned with the longitudinal axis of the creeper 10.

Installing the buttocks support pad or cushion 58 on the extended frame extension 16 is accomplished by positioning the locking tab 66 downwardly, generally over the crossmember slot 68. The cushion 58 is rotated ninety degrees to its normally installed orientation, so the lateral locking tab 66 is aligned with the longitudinal slot 68 which extends across the lateral crossmember 28. The tab 66 is inserted in the slot 68, and the cushion 58 is rotated to its normally installed position to capture the ends of the tab 66 beneath the sides of the slot 68, thereby securing the cushion 58 positively to the frame extension 16. The opposite ends of the support bar 60 rest atop the two lateral extension frame members 24 and 26, to support the buttocks cushion generally coplanar with the back rest pad 42. The two keeper tabs 64 reside immediately inboard of a respective extension frame member 24 or 26, and prevent rotation of the cushion 58 when installed.

Removal of the cushion 58 is accomplished by reversing the above steps for installation, with the cushion 58 being stored in its inverted orientation beneath the head and shoulder area of the back rest pad 42, and between the corresponding portions of the frame members 18, 20, and 22. The ends of the support bar 60 rest atop the two lateral frame members 18 and 20 and are captured between those frame members 18 and 20 and the overlying back rest pad 42 when the back rest pad is closed, to secure the buttocks cushion 58 in place for storage.

The head support end of the present mechanic's creeper 10 is relatively narrower than the majority of the device, as noted further above and as depicted in the various drawing Figs. Excessive width is not needed in this area, as only the width of the head of a person using the device need be supported across this area. This narrower head support area allows additional equipment to be installed thereon, without increasing the overall width of the assembly. The present mechanic's creeper 10 may include one or more (preferably a pair of) work lights 70 installed at the head end of each of the lateral frame members 18 and 20, generally adjacent the head crossmember 22.

Each work light 70 is preferably mounted upon an articulated arm 72, to allow the lights 70 to be raised, lowered, angled, and/or pivoted as desired, generally as shown in FIGS. 1 and 4, to direct the light to the desired area. The arms 72 fold compactly to allow the lights 70 to be nestled immediately alongside the narrower head portion of the main frame 14, and the head portion of the back rest pad 42 and its headrest 46. Preferably, the two work lights 70 are battery powered, in order to avoid the necessity of an electrical cord which may become tangled with other electrical power cords, air hoses, etc. during work. However, alternate electrical power for the lights 70 may be provided if so desired, comprising e.g. an external electrical power source, or perhaps a battery or batteries installed within the storage area 48 of the frame structure 14.

The two work lights 70 are adapted to provide illumination for working in a relatively poorly lighted area, as beneath a truck or other vehicle. The work lights 70 do little to provide any form of roadside warning of a disabled vehicle to others. Accordingly, a warning light(s) 74 may be provided for removable or permanent attachment to some point(s) on the frame 12 or other portion of the creeper 10, if so desired. In the exemplary creeper 10 of FIGS. 1 through 4, a removable warning light 74 may be stored within one of the tool and equipment receptacles 56 of the tool tray 54 until needed. The warning light 74 is removably secured to the head crossmember 22 of the creeper 10 by conventional mating hook and loop material 76, such as Velcro™, or other temporary fastening means as desired. Such warning lights are conventional and well known in the art and contain an electrical battery for power, an electrical switch, and a flasher circuit, and are used commonly on bicycles and the like.

Additional comfort and utility may be provided by a pair of removable arm rests 78, which may be installed to extend outwardly from each of the lateral main frame members 18 and 20. Each of the frame members 18 and 20 includes a pair of arm rest attachment slots 80, which may comprise metal brackets welded or otherwise secured to the exterior of the two main frame members 18 and 20. Each arm rest 78 includes a corresponding pair of attachment tabs 82 extending inwardly therefrom, with the arm rest attachment tabs 82 selectively engaging the corresponding arm rest attachment slots 80 as desired. The tabs 82 extending from the arm rests 78 are preferably angled at somewhat less than ninety degrees to the plane of their respective arm rests 78 in order to angle the arm rests 78 slightly upwardly relative to the plane of the back rest pad 42, for greater comfort for a person reclining on the present creeper 10.

Each of the arm rests 78 may include a tool pouch or pocket 84 depending from a support rod 86 disposed along the outboard edge of each arm rest 78. Other means of securing the tool pouches 84 to the arm rests 78 may be used, e.g. stapling or otherwise securing the flexible tool pouch 84 material directly to the bottom outer edge of each arm rest, etc., if so desired. This allows the tool pouches 84 to be folded upwardly against the undersides of the arm rests 78 for storage, where they may be secured in place by suitable attachment means, e.g. mating hook and loop fastener patches 88, or other means as desired. For use, the tool pouches 84 may be unfastened from their securing means 88 on the undersides of the armrests 78, to hang freely from their support rods 86.

The present creeper 10 with its attached equipment, along with the removable arm rests 78 and their tool pouches 84, may be stored and carried in a storage and carrying case 90 provided therefor. FIG. 2 of the drawings provides an illustration of such a carrying case 90 which is configured to hold the present creeper 10 and its accessories. The case 90 includes a lower portion 92 with a lid 94 secured thereto by conventional hinges 96. a series of latches 98 may be provided to secure the lid 94 to the lower portion 92, with a carrying handle 100 also extending from the case. The carrying case 90 is preferably formed of relatively rigid materials, e.g., molded or cast from reasonably high strength plastic materials, etc. Alternatively, the case 90 may be constructed of sheet metal or wood, if so desired.

Forming the case 90 of a molded plastic provides certain advantages in manufacture, particularly in the manufacture of certain details to provide a custom fit for the present mechanic's creeper 10 therein. The bottom portion 92 of the case 90 may include a relatively thick floor or raised subfloor 102, having a series of wheel or caster recesses 104 formed therein. A pair of arm rest receptacles 106 may also be provided in the floor 102, in which the two arm rests 78 rest beneath the creeper 10 when the assembly is stored within the case 90. The arm rest receptacles 106 preferably include extensions for the arm rest attachment tabs 82, which extend laterally from each arm rest 78. The two arm rests 78 when placed within the arm rest receptacles 106 of the case 90 are thus confined longitudinally and laterally within the receptacles 106, and cannot move vertically due to the underlying case floor 102 and overlying creeper 10 structure. The entire assembly is thus held securely within the case 90, with little or no play.

The present mechanic's creeper 10 will be appreciated by many mechanics and others who have occasion to work beneath a vehicle or in other areas of limited vertical space. The present creeper 10 is particularly valuable for professional truckers who often have need to work beneath their vehicles to adjust brakes or perform other routine maintenance. The present creeper 10 may be compactly carried within its carrying case 90, with the case 90 providing a compact package on the order of two feet in length by one foot in width by six inches in height. Such a compact storage unit is well suited for storage within the cab or sleeper unit of a truck tractor, or other area of limited storage spade such as a recreational vehicle, a truck or trailer used for the transport and support of a race car or similar vehicle, etc.

The present creeper 10 is easily readied for use by removing it from its storage and carrying case 90, lifting the back rest pad 42 to access the frame extension lock button 30, and extending the frame extension 16. The buttocks support cushion or pad 58 may also be removed from its storage area within the head end of the main frame 14 while the back rest 42 is raised, and installed upon the extended frame extension 16. Access to any tools and equipment which might be needed, as well as to the warning light 74, may also be made at this time with the back rest 42 raised. After the back rest 42 is lowered, the two arm rests 78 may be installed upon the left and right side main frame rails or members 18 and 20, and their tool pouches 84 extended and any tools and/or equipment needed placed therein, to complete the assembly. This entire process requires less than a minute to accomplish.

The present creeper 10 may then be used conventionally, allowing the user to position himself conveniently beneath a vehicle or in another work area with limited vertical space. The work light(s) 70 may be deployed and activated to illuminate the work area as needed, with the warning light 74 providing additional safety for the user of the present creeper 10 in area of darkness or poor lighting. When the work has been completed (e.g. adjusting truck brakes, etc.), the various lights may be turned off and folded or retracted, the back rest pad 42 raised, and any tools and equipment used, returned to the storage area or compartment 48 between the main frame members 18 and 20. The buttocks support pad or cushion 58 may also be placed within the head end of the main frame 14, and the frame extension 16 retracted and the back rest pad 42 lowered to secure the various tools, equipment, and buttocks pad 58 within the main frame 14. The two arm rests 78 are removed from the main frame 14 and placed within their storage receptacles 106 in the case 90, along with the folded creeper 10 structure, and the storage case lid 94 is closed and secured to allow the case 90 with its creeper 10 and accessories therein to be stored compactly for future use as needed.

The convenience and comfort provided by the present creeper 10 will greatly facilitate under vehicle maintenance and inspections for those who have occasion to perform such work while on the road, and for others as well. The present creeper makes such tasks much easier to perform, thus encouraging operators to perform such work as needed rather than delaying the work due to otherwise uncomfortable or unsatisfactory working conditions. The result is a safer operating environment for all when necessary adjustments, inspections, and other work are accomplished as required, rather than being postponed due to having inadequate tools and equipment while on the road.

It is to be understood that the present invention is not limited to the embodiment described above, but encompasses any and all embodiments within the scope of the following claims.

I claim:

1. A mechanic's creeper, comprising:

a hollow tubular main frame having at least a left side member, a right side member, and a head crossmember;

a frame extension having at least a left side member, a right side member, and a foot crossmember, with the left side member and the right side member of said frame extension telescopingly disposed respectively within the left side member and the right side member of said main frame;

a back rest pad secured to said main frame;

a buttocks support cushion removably attached to said frame extension;

a left and a right head end wheel depending from said main frame, near said head crossmember thereof; and a left and a right foot end wheel depending from said frame extension adjacent said foot crossmember thereof.

2. The mechanic's creeper according to claim 1, further including a tool and equipment storage compartment disposed between said left side member and said right side member of said main frame, and below said back rest pad.

3. The mechanic's creeper according to claim 1, further including a storage and carrying case therefor.

4. The mechanic's creeper according to claim 1, further including a left and a right arm rest removably attached respectively to said left side member and said right side member of said main frame.

5. The mechanic's creeper according to claim 4, further including a tool storage pouch foldably depending from each said arm rest.

6. The mechanic's creeper according to claim 1, further including at least one adjustably positionable work light extending from said main frame adjacent said head crossmember thereof.

7. The mechanic's creeper according to claim 1, further including a warning light removably attached to said main frame.

8. A mechanic's creeper, comprising:

a hollow tubular frame assembly having at least a left side member, a right side member, a head crossmember, and a foot crossmember;

a tool and equipment storage compartment disposed between the left side member and the right side member of said frame assembly;

a back rest pad hingedly secured to one of the side members of said frame assembly and over said tool and equipment storage compartment; and a left and a right head end wheel, and a left and a right foot end wheel, the wheels depending from said frame assembly.

9. The mechanic's creeper according to claim 8, wherein said frame assembly comprises:

a hollow tubular main frame having at least a left side member, a right side member, and a head crossmember;

a frame extension having at least a left side member, a right side member, and a foot crossmember, with the left side member and the right side member of said frame extension telescopingly disposed respectively within the left side member and the right side member of said main frame; and a buttocks support cushion removably attached to said frame extension.

10. The mechanic's creeper according to claim 8, further including a storage and carrying case therefor.

11. The mechanic's creeper according to claim 8, further including a left and a right arm rest removably attached respectively to said left side member and said right side member of said frame assembly.

12. The mechanic's creeper according to claim 11, further including a tool storage pouch foldably depending from each said arm rest.

13. The mechanic's creeper according to claim 8, further including at least one adjustably positionable work light extending from said frame assembly adjacent said head crossmember thereof.

14. The mechanic's creeper according to claim 8, further including a warning light removably attached to said frame assembly.

15. A mechanic's creeper, comprising:

a hollow tubular frame assembly having at least a left side member, a right side member, a head crossmember, and a foot crossmember;

a back rest pad secured to said main frame;

a left and a right head end wheel, and a left and a right foot end wheel, the wheels depending from said frame assembly;

a hollow tubular main frame having at least a left side member, a right side member, and a head crossmember;

a frame extension having at least a left side member, a right side member, and a foot crossmember, with the left side member and the right side member of said frame extension telescopingly disposed respectively within the left side member and the right side member of said main frame;

a buttocks support cushion removably attached to said frame extension; and a storage and carrying case configured for storing and carrying therein, at least said frame assembly including said back rest pad and each said wheel.

16. The mechanic's creeper according to claim 15, further including a tool and equipment storage compartment disposed between said left side member and said right side member of said frame assembly, and below said back rest pad.

17. The mechanic's creeper according to claim 15, further including:

at least one adjustably positionable work light extending from said frame assembly adjacent said head crossmember thereof; and a warning light removably attached to said frame assembly.

18. A mechanic's creeper, comprising:

a hollow tubular frame assembly having at least a left side member, a right side member, a head crossmember, and a foot crossmember;

a back rest pad secured to said main frame;

a left and a right head end wheel, and a left and a right foot end wheel, the wheels depending from said frame assembly;

a left and a right arm rest removably attached respectively to said left side member and said right side member of said frame assembly;

a tool storage pouch foldably depending from each said arm rest; and a storage and carrying case configured for storing and carrying therein, at least said frame assembly including said back rest pad and each said wheel.

* * * * *